United States Patent [19]

Webster

[11] Patent Number: 4,872,853

[45] Date of Patent: Oct. 10, 1989

[54] CIRCUIT CARD RETAINING DEVICE

[75] Inventor: Van K. Webster, Camp Hill, Pa.

[73] Assignee: AMP Incorporated, Harrisburg, Pa.

[21] Appl. No.: 281,579

[22] Filed: Dec. 8, 1988

[51] Int. Cl.[4] ..... H01R 13/629; H01R 13/635

[52] U.S. Cl. ..... 439/327; 439/62

[58] Field of Search ..... 439/59, 62, 69, 76, 439/259–267, 325, 327, 328, 345, 352, 372, 377; 361/413, 415; 811/41

[56] References Cited

U.S. PATENT DOCUMENTS 2,825,037 2/1958 French ..... 439/325 X
3,801,953 4/1974 Lynch .
4,480,884 11/1984 Babuka et al. .
4,579,411 4/1986 Cobaugh et al. ..... 439/327

FOREIGN PATENT DOCUMENTS 0037653 4/1965 German Democratic Rep. ..... 361/415

*Primary Examiner*—Eugene F. Desmond
*Attorney, Agent, or Firm*—Allan B. Osborne

[57] ABSTRACT

A retaining device for retaining a circuit card in a zero insertion force card edge connector. More particularly, the device inclues a u-shaped member formed from spring wire and whose legs are bent into a concavo-convex shape so that the member can be resiliently elongated.

4 Claims, 3 Drawing Sheets

CIRCUIT CARD RETAINING DEVICE

FIELD OF INVENTION

The invention disclosed herein relates to devices for retaining circuit cards in card edge connectors of the type wherein the contact elements are cammed into engagement with the circuit card after its insertion into the connector.

BACKGROUND OF THE INVENTION

U.S. Pat. No. 4,480,884 discloses a circuit card retention and polarization arrangement for a zero insertion force card edge connector. The arrangement includes a pin and pin slot on the card and a like pin and pin slot in the connector but in a reverse pattern; i.e., pin slot is provided in the leading side of the card, a receiving pin therefore is located at the remote end of the card slot in the connector, a pin slot is provided adjacent the entrance to the card slot and a receiving pin therefore is located on the trailing side of the card. As can be discerned from the foregoing, the card must be inserted into the card slot from one side thereof to effectuate the mating of the respective pins and slots. This requirement forecloses using the circuit card, with its laterally extending pins, in those cases where the card must be top loaded into the card slot. Accordingly, it is now proposed to provide a circuit card retaining device which does not restrict the direction in which the card can be inserted into the connector and further which requires only a very small slot in one side of the circuit card.

SUMMARY OF THE INVENTION

According to the invention, a retaining device for retaining a circuit card in a zero insertion force connector is provided. The device comprises a U-shaped member of spring wire having a concavo-convex shape which permits a resilient lengthening thereof. The free ends are pivotally attached to the connector and the bight is adapted to be placed into a slot in one side of the circuit card.

DESCRIPTION OF THE INVENTION

Figures 1, 2:
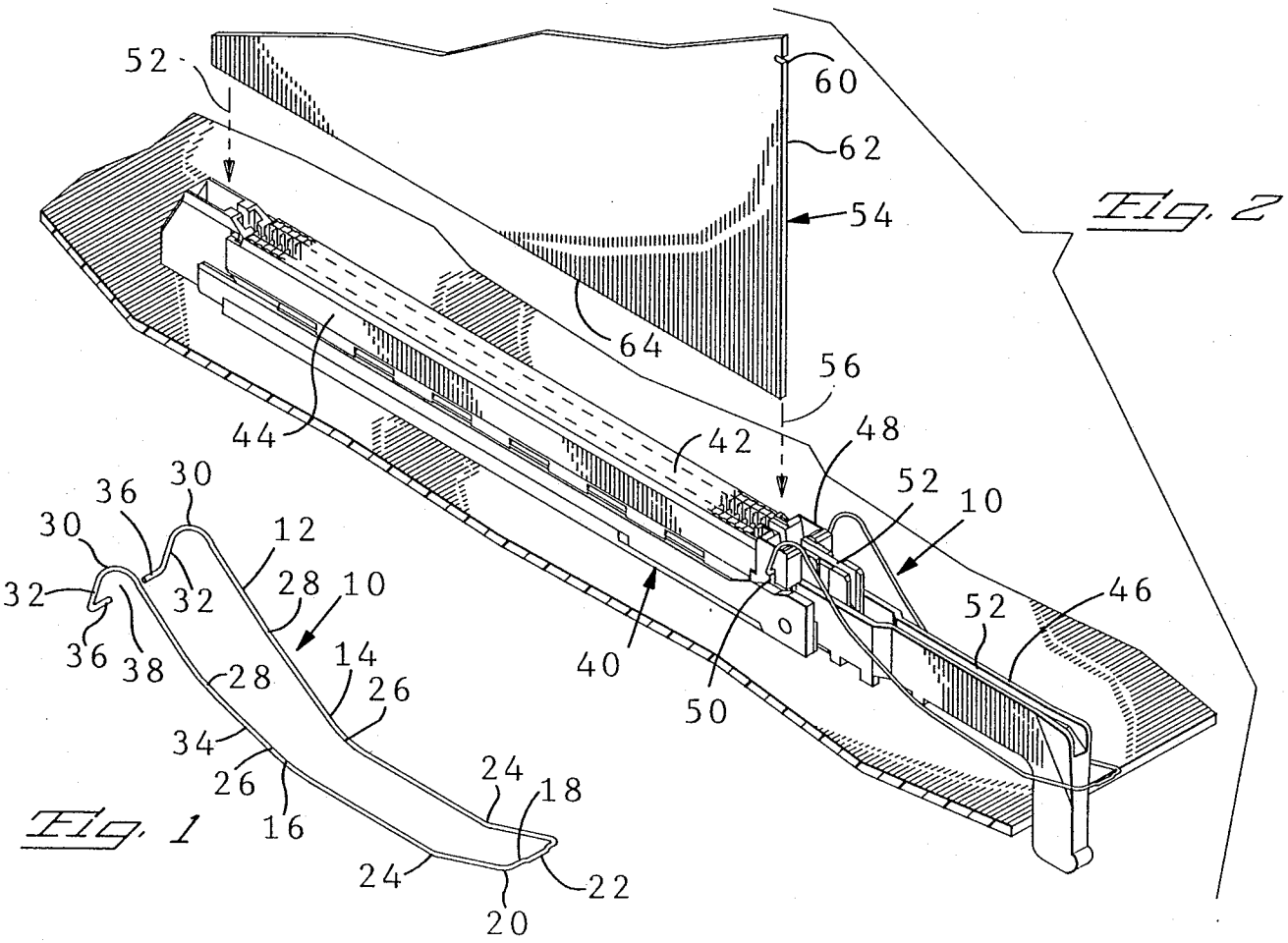
FIG. 1 is a perspective view of the retaining device apart from the connector.
FIG. 2 is a perspective view of a card edge connector incorporating the retaining device of the present invention and of a circuit card adapted for use therewith.

As shown in FIG. 1, retaining device 10 of the present invention is formed from a piece of spring wire 12 such as music wire. Wire 12 is bent into a general u-shape comprising legs 14, 16 and bight 18 at closed end 20. Bight 18 includes off-set portion 22.

The shape of legs 14, 16 are identical and include bends 24, 26, 28 and curves 30. As shown more clearly in FIG. 4, bends 24, 26, 28 provide device 10 with a concavo-convex shape, particularly as viewed from a side thereof. Curves 30 deflect ends 32 of legs 14, 16 towards the convex side 34 with the angle of deflection being about ninety degrees relative to the general longitudinal axis of device 10. Free end portions 36 of ends 32 are bent inwardly; i.e., so that they face each other, with space 38 therebetween being a predetermined distance as will be explained below.

The drawing in FIG. 2 shows device 10 attached to connector 40 which is a high density, zero insertion force card edge connector made and sold by AMP Incorporated of Harrisburg, Pennsylvania, the assignee of the present invention. Connector 40 includes card-receiving slot 42, upper housing 44 which is moved vertically by rotating handle 46. End block 48 of housing 44 include openings 50 on each side thereof. Slot 42 is open upwardly and also laterally through groove 52 running through block 48 and handle 46. Thus, circuit card 54, shown above connector 40, can be inserted into slot 42 from above as indicated by arrows 56, or from the side through groove 52.

Figure 4:
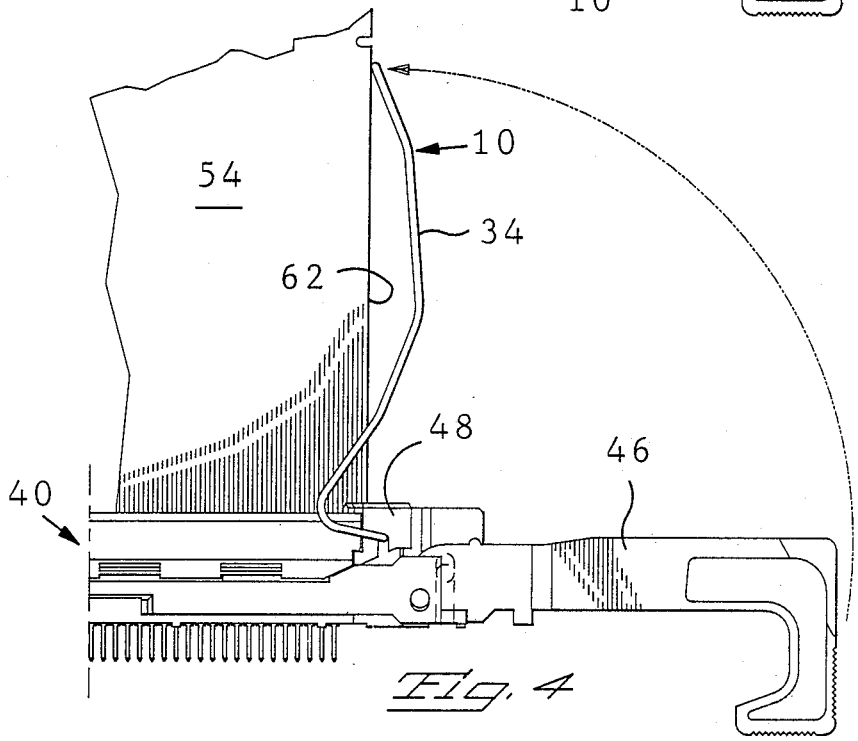

Retaining device 10 is pivotally attached to connector 40 by placing free end portions 36 into openings 50 in block 48. Space 38 between portions 36 is slightly smaller than the width of block 48 between openings 50 so that free end portions 36 are under compression and will not fall out. Device 10 is positioned so as to enclose handle 46 within the confines of legs 14, 16 and bight 18 as shown in FIG. 1 and is pivotable in both clockwise and counterclockwise directions. As shown in FIG. 4, convex side 34 of device 10 faces outwardly away from card 54 as inserted into slot 42.

The only modification to circuit card 54 needed is locating a narrow slot 60 on side 62 at a predetermined distance from edge 64.

Figure 3:
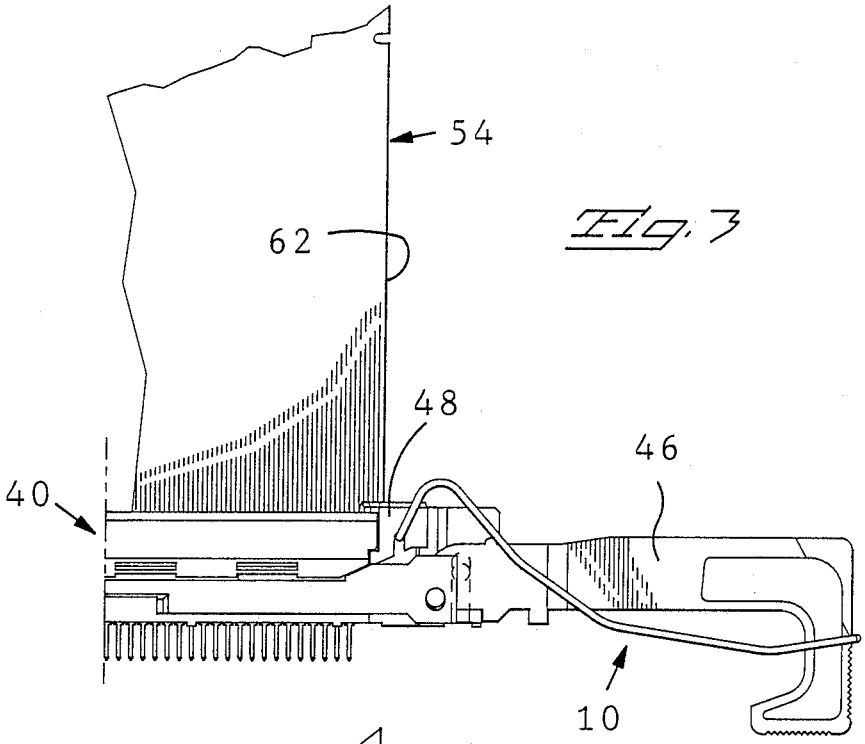
FIGS. 3, 4, 5 and 6 are side views illustrating the steps employed in using the retaining device.
Figure 5:
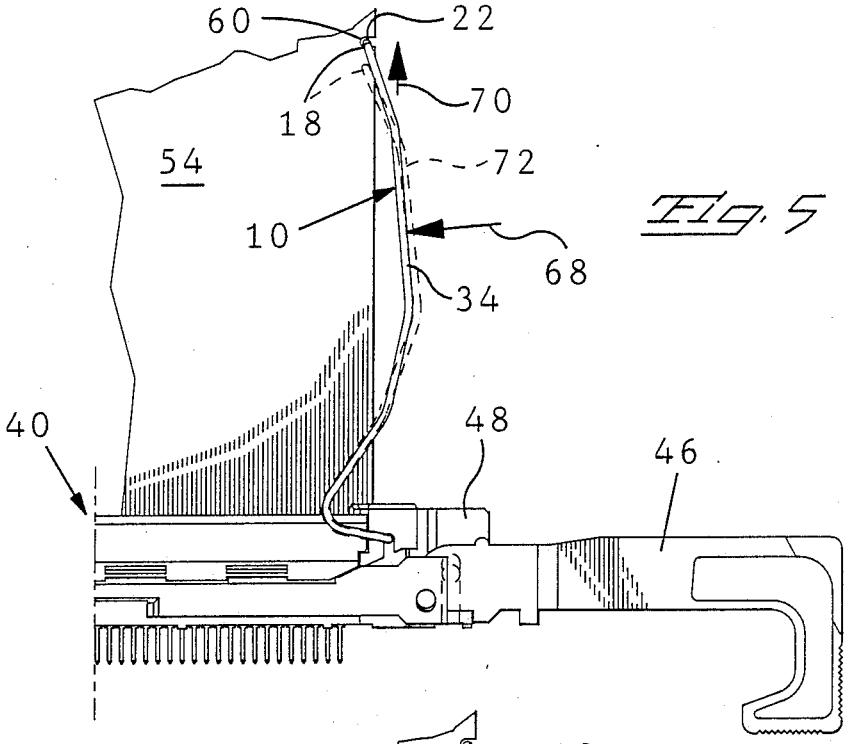
Figure 6:
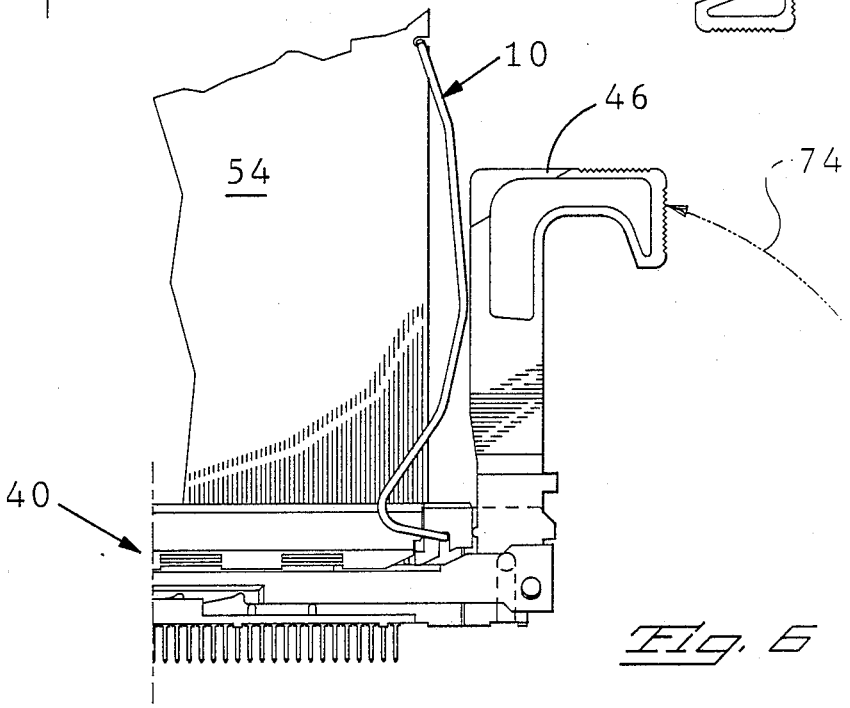

FIG. 3 shows circuit card 54 inserted into slot 42 in connector 40. Retaining device 10 is pivoted upwardly from its rest position around handle 46 to abut side 62 of card 54 as indicated by arrow 66 in FIG. 4. With reference to FIG. 5, pressure against convex side 3 of device 10, as indicated by arrow 68, causes device 10 to elongate, as indicated by arrow 70, whereupon bight 18, and more particularly, offset portion 22 thereon, to enter slot 60. The original shape of device 10 is indicated by phantom lines 72. The elongation places device 10 under tension and accordingly, exerts a downward force on card 54; i.e., towards connector 40. Thus, as handle 46 is pivoted upwardly, as indicated by arrow 74 in FIG. 6, and the contact elements (not shown) within connector 40 are cammed into engagement with card 54, card 54 will remain stationary and not move upwardly or shift.

As can be discerned, a retaining device for retaining circuit cards in zero insertion force, card edge connectors has been disclosed. The retaining device includes a u-shaped spring wire member which is pivotally mounted on the connector and is resiliently forced into a slot in one side of the circuit card inserted into the connector. The resilient deformation provides a continuous force on the card to retain it in the connector and keep it from moving as the contact elements in the connector are cammed into engagement therewith.

I claim:

1. A retaining device for card edge connectors which receive circuit cards having a slot in one side thereof and which are inserted into the connector with the slot being at a predetermined distance therefrom, said retaining device comprising an elongated, U-shaped member formed from spring wire and having parallel legs joined at one end by a bight and having free ends pivotally attached to the connector at one end thereof, said legs including parallel concavo-convex shaped portions between said bight and said free ends whereby the length of said member may be resiliently elongated to a predetermined length to enable said bight to be placed in the slot in the circuit card which may be placed in the connector and thereby exert a retaining force on the circuit card to hold it in the connector.

2. The retaining device of claim 1 wherein the free ends are inwardly turned and are received in holes in the connector.

3. The retaining device of claim 2 wherein said free ends are deflected towards the convex side of said concavo-convex shaped portion of said legs.

4. The retaining device of claim 3 with said deflection being at an angle of about ninety degrees relative to the general longitudinal axis of said legs.

* * * * *